US005977692A

United States Patent [19]

Itaya et al.

[11] Patent Number: 5,977,692

[45] Date of Patent: Nov. 2, 1999

[54] ANNULUS FLUORESCENT LAMP WITH OVERHEAT PROTECTION

[75] Inventors: Kenji Itaya; Takeshi Matsumura, both of Osaka, Japan

[73] Assignee: Matsushita Electronics Corporation, Osaka, Japan

[21] Appl. No.: 09/049,456

[22] Filed: Mar. 27, 1998

[30] Foreign Application Priority Data

| | | | |
|---|---|---|---|
| Mar. 31, 1997 | [JP] | Japan | 9-079450 |
| Jan. 20, 1998 | [JP] | Japan | 10-008303 |

[51] Int. Cl.[6] ..... H01J 61/56

[52] U.S. Cl. ..... 313/37; 315/100; 315/119; 313/493

[58] Field of Search ..... 315/100, 75, 119; 313/37, 39, 493, 634, 635, 485, 486, 487

[56] References Cited

U.S. PATENT DOCUMENTS

| | | | |
|---|---|---|---|
| 4,649,320 | 3/1987 | Hough et al. | 315/100 |
| 4,857,808 | 8/1989 | Lally et al. | 315/100 |
| 5,034,655 | 7/1991 | Murayama et al. | 313/493 |
| 5,629,586 | 5/1997 | Yasuda et al. | 315/46 |
| 5,723,939 | 3/1998 | Okuno et al. | 313/493 |

FOREIGN PATENT DOCUMENTS

| | | | |
|---|---|---|---|
| 0 720 208 | 7/1996 | European Pat. Off. | H01J 61/32 |
| 0 758 131 | 2/1997 | European Pat. Off. | H01C 7/02 |
| 56-3967 | 1/1981 | Japan | H01J 61/56 |
| 2-61956 | 3/1990 | Japan | H01J 61/32 |
| 2-192650 | 7/1990 | Japan | H01J 61/56 |
| 4-19901 | 1/1992 | Japan | H01J 61/50 |
| 4-61740 | 2/1992 | Japan | H01J 61/56 |
| 6-203798 | 7/1994 | Japan | H01J 61/32 |
| 8-236074 | 9/1996 | Japan | H01J 61/32 |
| 2 186 738 | 8/1987 | United Kingdom | H01J 17/38 |
| 2 222 023 | 2/1990 | United Kingdom | H01J 17/34 |

OTHER PUBLICATIONS

Communication from European Patent Office and attached Search Report.

*Primary Examiner*—Michael Day
*Attorney, Agent, or Firm*—Merchant & Gould P.C.

[57] ABSTRACT

An annulus fluorescent lamp comprises two annulus fluorescent tubes formed into shapes having different diameters and disposed substantially concentrically in substantially the same plane. Each of the annulus fluorescent tubes has a first end with an electrode seal portion and a second end without electrodes. The second ends of the annulus fluorescent tubes are communicated with each other via a bridge portion so that a single discharge path is formed inside the plurality of annulus fluorescent tubes. The annulus fluorescent lamp also comprises a mouthpiece covering the first and second ends of the annulus fluorescent tubes, and a thermal fuse disposed in the mouthpiece and close to the electrode seal portion of the annulus fluorescent tubes. The thermal fuse is connected electrically between one of outer lead wires of the electrodes and one of lead terminals fixed to the mouthpiece. The thermal fuse is connected thermally to the surface of the annulus fluorescent tubes at a portion close to the electrode seal portion via a silicone resin. When the electrode seal portion is overheated in the last period of the lamp life, the thermal fuse cuts off current supply to the annulus fluorescent tubes.

6 Claims, 6 Drawing Sheets

ANNULUS FLUORESCENT LAMP WITH OVERHEAT PROTECTION

BACKGROUND OF THE INVENTION

This invention relates to an annulus fluorescent lamp that comprises a plurality of fluorescent tubes having different diameters and communicating with each other at a bridge portion.

It is known that a temperature of an electrode seal portion of a fluorescent lamp rises excessively when the lamp approaches the end of its life. A method for protecting against such an excessive temperature rise in the last period of the lamp life is disclosed in Japanese laid-open patent application (Tokukai-hei) 2-192650 or 4-19901, for example. In this method, a thermal fuse provided close to the end portion of the fluorescent tube fuses as the temperature of end portion rises excessively to cut off the drive circuit of the fluorescent tube.

Recently, a new type of annulus fluorescent lamp with high efficiency, compact size and light weight is proposed in Japanese laid-open patent application (Tokukai-hei) 2-61956, 6-203798 or 8-236074, for example. This type of annulus fluorescent lamp comprises two small fluorescent tubes having different diameters, disposed substantially concentrically in substantially the same plane. These fluorescent tubes are communicated with each other at a bridge portion so that a single discharge path is formed inside the fluorescent tubes. The lamp also comprises a high frequency inverter circuit to drive the fluorescent tubes.

Such an annulus fluorescent lamp has the following disadvantage to be improved. Generally speaking, in the last period of the life of a fluorescent lamp, an electron emitting substance of a filament is exhausted, so that a cathode voltage drop increases. As a result, a power loss at the filament (i.e., electrode) increases and the temperature at the electrode seal portion rises excessively.

In addition, some high frequency inverter circuits may continue to provide a preheat current to the fluorescent tube even if the fluorescent tube becomes unable to light due to the increasing cathode voltage drop. In this case, an arc discharge can occur between the inner lead wires connected to the electrodes, or an electrical breakdown can occur on the glass surface of the electrode seal portion that seals the inner lead wires. Such phenomena can occur if the current supply capability of the high frequency inverter circuit is high.

Especially, each of the above mentioned double annulus fluorescent tubes has a small diameter, and the electrode seal portion of the annulus fluorescent tube is covered with a plastic mouthpiece. Therefore, the temperature rise is remarkable and the cooling ability is not good at the electrode seal portion. Thus, the mouthpiece can be heated excessively to be distorted by the heat.

Furthermore, such a double annulus fluorescent lamp has a lowest temperature portion at a bridge portion side that is opposite to the electrode seal portion of the annulus fluorescent tube, and the heat of the electrode seal potion can be conducted to the lowest temperature portion easily since the electrode seal portion and the lowest temperature portion are covered with a single mouthpiece. If the temperature of the electrode seal portion rises in the last period of the life of fluorescent lamp, the lowest temperature portion is heated excessively. As a result, a mercury vapor pressure in the annulus fluorescent tube rises excessively out of a proper range, and the lamp luminosity and luminescence efficiency go down.

As explained above, the double annulus fluorescent lamp has a disadvantage, that is an excessive rise of temperature at the electrode seal portion in the last period of the life of a fluorescent lamp resulting in the distortion of the mouthpiece, and the decreases of the lamp luminosity and luminescence efficiency.

SUMMARY OF THE INVENTION

An object of the present invention is to provide a safer annulus fluorescent lamp that can cut off current supply to the fluorescent tube when the temperature at the electrode seal portion rises excessively in the last period of the annulus fluorescent lamp.

It is another object of the present invention to prevent a significant decrease of the lamp luminosity and the luminescence efficiency in the last period of a fluorescent lamp.

An annulus fluorescent lamp of the present invention comprises a plurality of annulus fluorescent tubes having different diameters and disposed substantially concentrically in substantially the same plane. Each of the annulus fluorescent tubes has a first end with an electrode seal portion and a second end without electrodes. The second ends of the annulus fluorescent tubes are communicated with each other via a bridge portion so that a single discharge path is formed inside the plurality of annulus fluorescent tubes. The first and second ends of the annulus fluorescent tubes are covered with a mouthpiece. In the mouthpiece and close to the electrode seal portion, an overheat protection component such as a thermal fuse is provided, which is connected electrically between at least one of outer lead wires of the electrodes and one of lead terminals fixed to the mouthpiece. The overheat protection component is connected thermally to the surface of the annulus fluorescent tubes at a portion close to the electrode seal portion via a resin. When the electrode seal portion is overheated in the last period of the lamp life, the heat is conducted to the overheat protection component via the resin, so that the overheat protection component cuts off the current supply to the annulus fluorescent tubes.

According to the present invention, a safer multiannulus lamp is provided, whose mouthpiece is not distorted by the overheating of the electrode seal portion in the last period of the lamp life, since the overheat protection component provided close to the electrode seal portion cuts off a current supply to the annulus fluorescent tubes when the electrode seal portion is overheated.

It is preferable that the overheat protection component is disposed between the plural annulus fluorescent tubes at the portion close to the electrode seal portion, and fixed to the surface of the annulus fluorescent tubes at the portion close to the electrode seal portion with a resin. The resin is preferably selected from a silicone resin that has a high heat conductivity. Thus, the overheat protection component is connected thermally to the surface of the annulus fluorescent tube at the portion close to the electrode seal portion, so that the overheat protection component can cut off the current supply to the fluorescent tubes when the electrode seal portion is overheated. A single overheat protection component can cut off the current supply from a drive circuit (inverter circuit) to the plural annulus fluorescent tubes even if only one of the electrode seal portions of the plural fluorescent tubes is overheated.

It is also preferable that the inner face of the mouthpiece has a heat shielding wall, which shields thermally the second ends from the first ends of the annulus fluorescent tubes. It is also preferable that through holes for ventilation are provided for the mouthpiece at the portion corresponding to the second end of the annulus fluorescent tube. According to this configuration, the temperature rise of the lowest temperature portion in the second end of the annulus fluorescent tube can be suppressed even if the electron seal portion is heated in the last period of the lamp life. Thus, decreasing of luminescence efficiency due to the temperature rise at the lowest temperature portion can be suppressed.

Preferably, a holder (e.g., a rib) that holds the annulus fluorescent tube at the portion close to the second end is provided in the mouthpiece. This holder restricts the position of the lowest temperature portion of the annulus fluorescent tube with respect to the position of the through holes for ventilation, so that the temperature variation at the lowest temperature portion as well as the luminosity variation of each lamp becomes small.

DETAILED DESCRIPTION OF THE PREFERRED EMBODIMENTS

Figure 1:
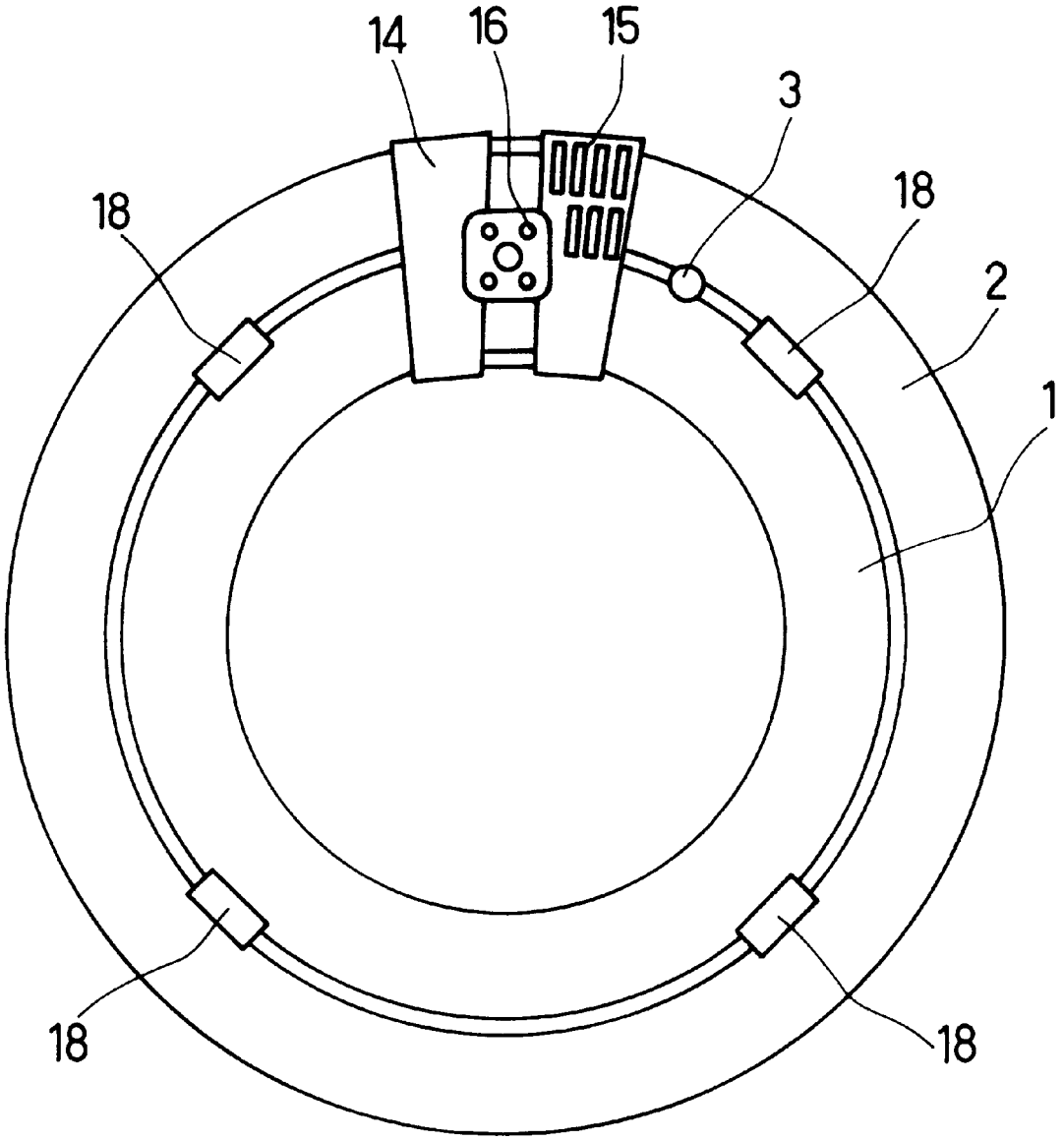
FIG. 1 is a plan view of an annulus fluorescent lamp according to an embodiment of the present invention.

Referring to FIG. 1, an annulus fluorescent lamp according to an embodiment of the present invention comprises two annulus fluorescent tubes 1, 2 having different diameters and disposed substantially concentrically in substantially the same plane. Each of the annulus fluorescent tubes has a first end that is an electrode seal portion and a second end without electrodes. The second ends of the two annulus fluorescent tubes are communicated with each other via a bridge portion 3. Thus, a single discharge path is formed inside the two annulus fluorescent tubes 1, 2, which can be made of glass.

Figure 2:
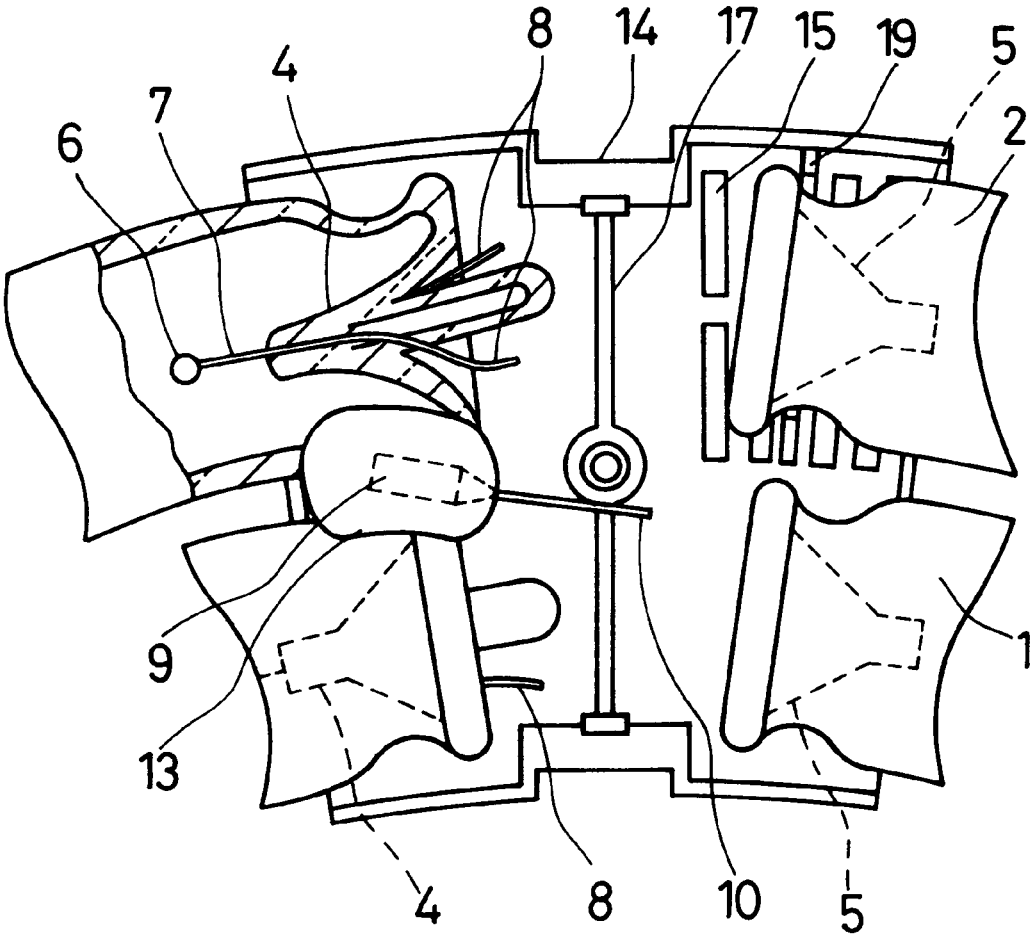
FIG. 2 is an inside plan view of a mouthpiece of the annulus fluorescent lamp shown in FIG. 1.

As shown in FIG. 2, the first ends of the annulus fluorescent tubes 1, 2 are closed with electrode seal portion 4 including a glass stem that seals two inner lead wires 7 supporting an electrode 6. The second ends of the annulus fluorescent tubes 1, 2 are closed with a non-electrode seal portion 5 including a glass stem without electrodes.

The inner surfaces of the annulus fluorescent tubes 1, 2 are coated with a rare-earth fluorescent material. Inside of the tubes 1, 2 are enclosed mercury and a noble gas such as argon or neon at 200–500 Pa for startup assistance gas. Instead of mercury, a zinc amalgam can be used.

The two annulus fluorescent tubes 1, 2 can be fixed to each other at plural locations with a resin 18 such as a silicone.

The first and second ends of the annulus fluorescent tubes 1, 2 are covered with a mouthpiece 14 made of a plastic material such as polyethylene terephthalate (PET) or polybutylene terephthalate (PBT). The mouthpiece 14 includes an upper half and a lower half that are divided by a center section plane of the annulus fluorescent tubes 1, 2. The two halves are fixed to each other with a screw. Each of the upper and lower halves of the mouthpiece 14 is provided with several slots (i.e., through holes) 15 for ventilation in the area where the second ends (i.e., the lowest temperature portions) of the annulus fluorescent tubes are positioned. In addition, the inner face of the mouthpiece half 14 is provided with a heat shielding wall 17 as shown in FIG. 2. The heat shielding wall 17 thermally separates the first ends (i.e., electrode seal portions) 4 from the second ends (i.e., non-electrode seal portions) 5 of the annulus fluorescent tubes 1, 2. The heat shielding wall 17 of the mouthpiece 14, in cooperation with the slots 15 for ventilation, prevents the lowest temperature portions of the fluorescent tubes from being heated by the electrode seal portion 4 in the last period of the lamp life, so that the lamp luminosity and luminescence efficiency are maintained.

Figure 3:
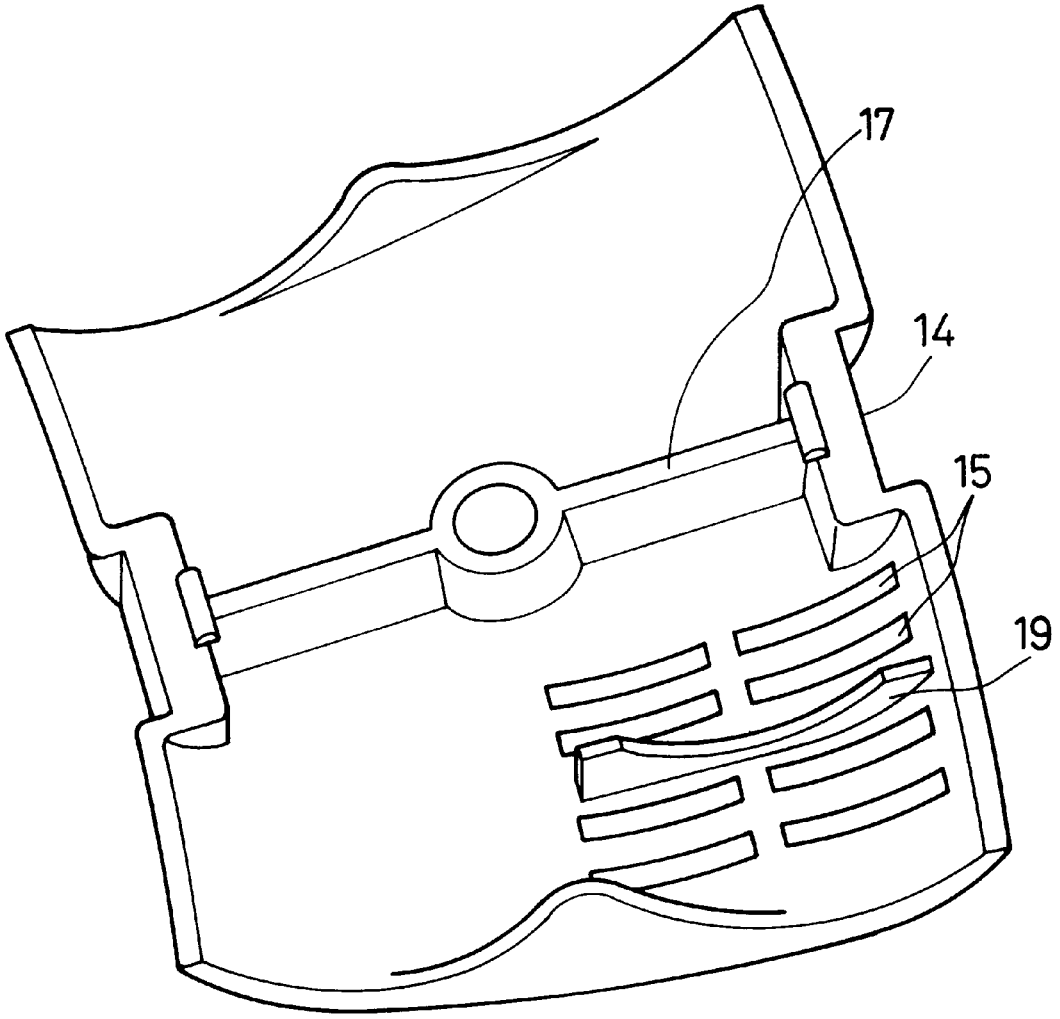
FIG. 3 is a perspective inner view of a mouthpiece half of the annulus fluorescent lamp shown in FIG. 1.

Moreover, as shown in FIG. 3, the inner face of the mouthpiece 14 has a rib 19 as a holder that holds the annulus fluorescent tube 2 at the non-electrode seal portion 5. The rib 19 has a concave contour with a radius a little larger than the thickness of the annulus fluorescent tube 2 at the constricted portion near the non-electrode seal portion 5. The rib 19 holds the constricted portion of the annulus fluorescent tube 2, so that misregistration between the annulus fluorescent tubes 1, 2 and the mouthpiece 14 is restricted. Thus, since registration of the lowest temperature portion of the annulus fluorescent tubes 1, 2 and the slots 15 for ventilation is maintained, variation of a temperature at the lowest temperature portions of the annulus fluorescent tubes, as well as variation of the lamp luminosity, becomes small.

The upper half of the mouthpiece is provided with four lead terminals 16 as shown in FIG. 1. Each lead terminal 16 is a hollow pin, which receives one of the outer lead wires 8 extending from the electrode seal portion 4 as shown in FIG. 2, or a lead wire 10 of a thermal fuse that is explained below. Each of the lead wires 8, 10 is welded to the tip of the terminal 16.

The thermal fuse 9 as an overheat protection component is connected electrically between one of the outer lead wires 8 and one of the lead terminals 16. As shown in FIG. 2, the thermal fuse 9 is disposed between the annulus fluorescent tubes 1, 2 at a portion close to the electrode seal portion and fixed to the surfaces of the fluorescent tubes 1, 2 with a silicone resin 13. Thus, the thermal fuse 9 is thermally connected to the surfaces of the fluorescent tubes 1, 2 at the portion close to the electrode seal portion 4 via the silicone resin 13. Instead of the silicone resin, another resin may be used, as long as it has high heat conductivity, adhesiveness, heat resistance, and endurance.

In an example, an annulus fluorescent lamp rated at 40 watts according to the present invention has the following dimensions: the tube diameter of the annulus fluorescent tubes 1, 2 is 20 millimeters; the outer shape diameter of the outer annulus tube 2 is 200 millimeters; the inner shape diameter of the inner annulus tube 1 is 114 millimeters; and the distance between the annulus fluorescent tubes 1, 2, i.e., the length of the bridge portion 3, is approximately 3 millimeters.

The operation of the annulus fluorescent lamp according to the present invention, i.e., the operation for cutting off the current supply to the annulus fluorescent tubes in the last period of the lamp life will be explained below.

Figure 4:
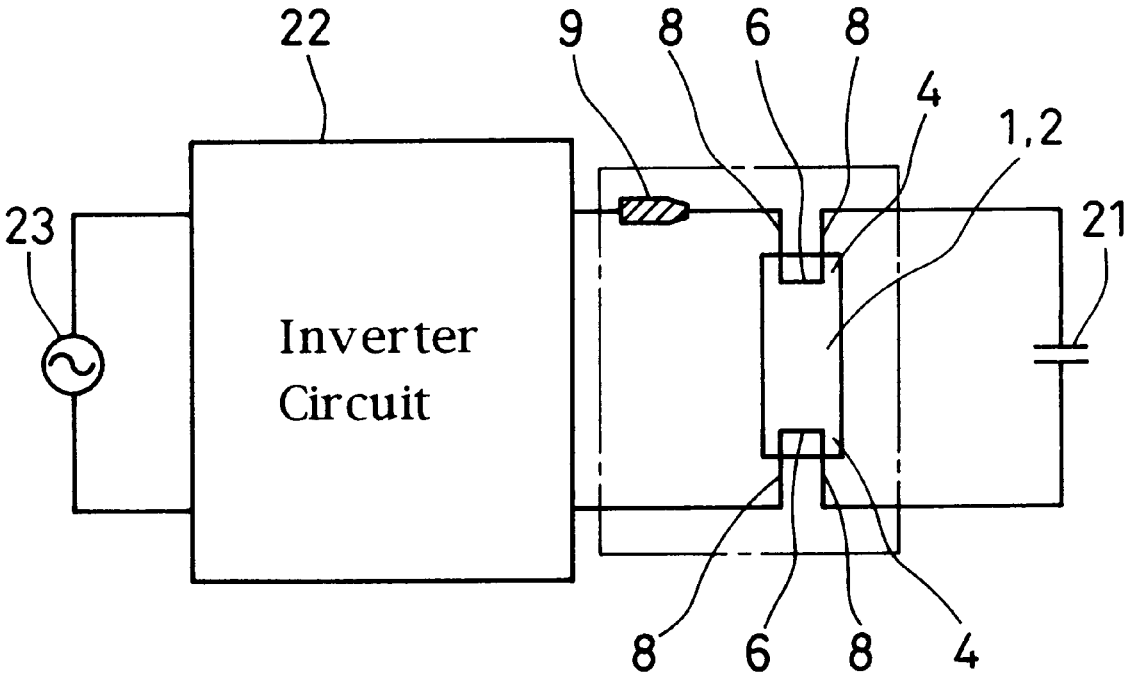
FIG. 4 is a circuit diagram of the annulus fluorescent lamp and its drive circuit.

FIG. 4 is a circuit diagram of the annulus fluorescent lamp according to the present invention and its drive circuit. The block enclosed by a chain line corresponds to the annulus fluorescent lamp according to the present invention. The drive circuit includes capacitor 21 and inverter circuit 22 that is connected to AC 100 volt power source 23.

If the electrode seal portion 4 of the annulus fluorescent tube is overheated in the last period of the lamp life, the thermal fuse 9 disposed close to the electrode seal portion 4 will be fused. Consequently, the current supply from the inverter circuit 22 to the annulus fluorescent tubes 1, 2 is cut off. Thus, the temperature rise of the electrode seal portion and the mouthpiece is suppressed.

Instead of the thermal fuse, other overheat protection components may be used. For example, a heat-sensitive switch such as a bimetal thermal switch can be used. In this case, the bimetal thermal switch will be opened corresponding to the heat to cut off the current supply to the annulus fluorescent tubes 1, 2. It is preferable to use a so-called fail-safe type switch since it will not return to the closed state when the temperature goes down. The switch must be small enough to be disposed in the mouthpiece.

As mentioned above, the thermal fuse 9 is connected thermally to the surface of the annulus fluorescent tubes 1, 2 at the portion close to the electrode seal portion 4 via the silicone resin. Therefore, the thermal fuse is rapidly fused when the electrode seal portion is overheated. Also, since the thermal fuse 9 is disposed between two annulus fluorescent tubes 1, 2 at the portion close to the electrode seal portion, a single thermal fuse 9 can cut off the current supply to the fluorescent tubes 1, 2 even if only one of electrode seal portions 4 of two annulus fluorescent tubes 1, 2 is overheated in the last period of the lamp life.

The fusing temperature of the thermal fuse 9 should be within the range of 140–400 degrees Celsius. If the fusing temperature is below 400 degrees Celsius, the distortion of the mouthpiece can be suppressed. Also, the normal temperature of the mouthpiece under the normal lighting condition is below 140 degrees Celsius. It is very rare that the thermal fuse might be fused by accident.

The thermal fuse 9 is preferably connected between the electrode 6 and the inverter circuit 22 as shown in FIG. 4, so that the current supply is securely cut off. The electric connection of the annulus fluorescent tubes and the inverter circuit is usually determined in single state in accordance with shapes of the mouthpiece and a connector of the inverter circuit fitting each other. Therefore, the outer wire 8 and the lead terminal 16 are connected so that the thermal fuse 9 is connected between the electrode 6 and the inverter circuit 22 when the mouthpiece and the connector of the inverter circuit are engaged with each other. However, the thermal fuse may be connected between the electrode 6 and the capacitor 21 in another embodiment. In this case, restart of the annulus fluorescent lamp may be securely suppressed after the lamp goes off.

In an experiment, a large annulus fluorescent tube whose outer diameter (i.e., thickness) is more than 22 millimeter did not suffer from significant overheating of the electrode seal portion nor the distortion of the mouthpiece in the last period of the lamp life. On the contrary, if the outer diameter of the annulus fluorescent tube is less than 22 millimeter but more than 13 millimeter, the distortion of the mouthpiece seldom occurred. If the outer diameter of the annulus fluorescent tube is less than 13 millimeter, the distortion of the mouthpiece increased. It is considered that a thermal capacity of the electrode seal portion and the mouthpiece, as well as the cooling ability, decreases if the outer diameter of the annulus fluorescent tube becomes smaller.

The following explanation is directed to a method for connecting the thermal fuse to the annulus fluorescent lamp in its manufacturing process.

Figure 5:
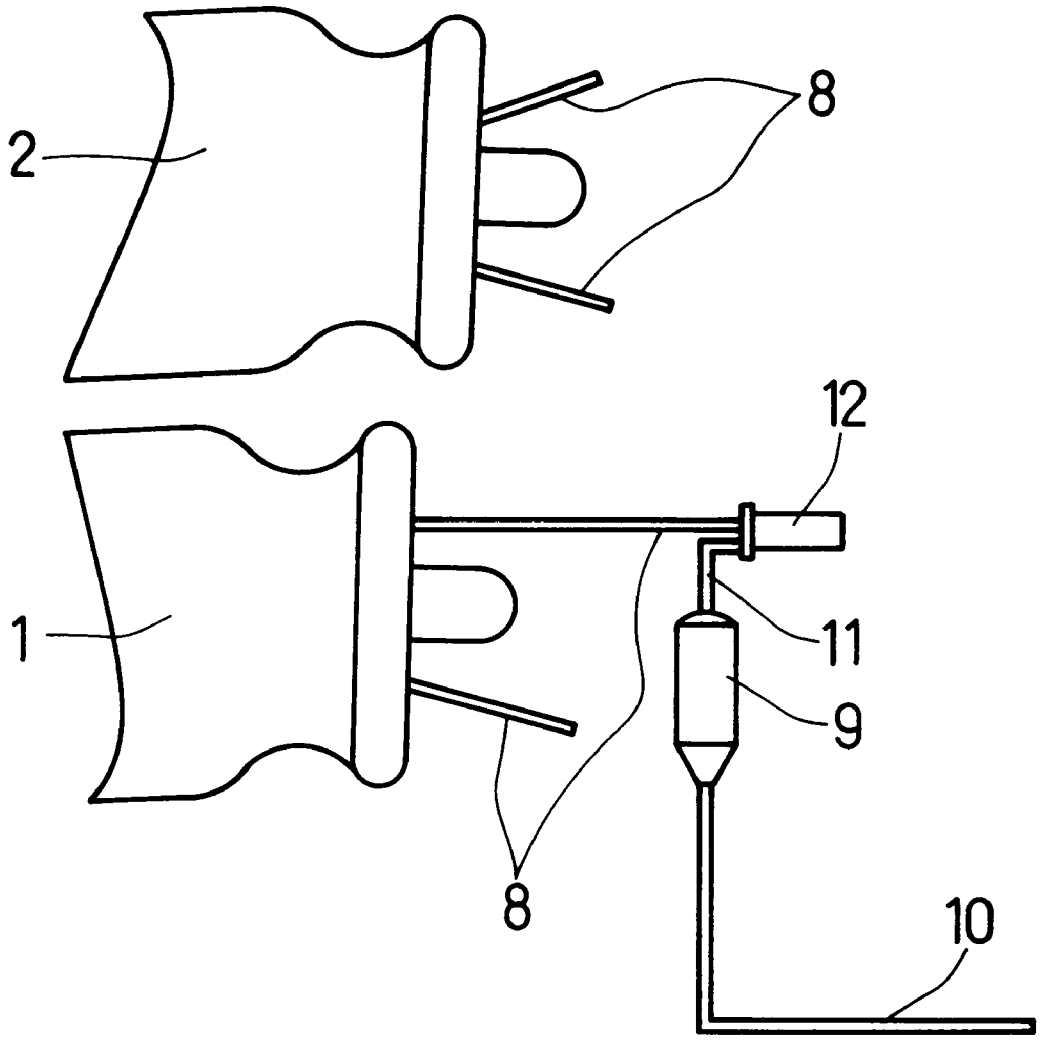
FIGS. 5 and 6 show manufacturing steps for connecting a thermal fuse to the annulus fluorescent lamp according to the present invention.
Figure 6:
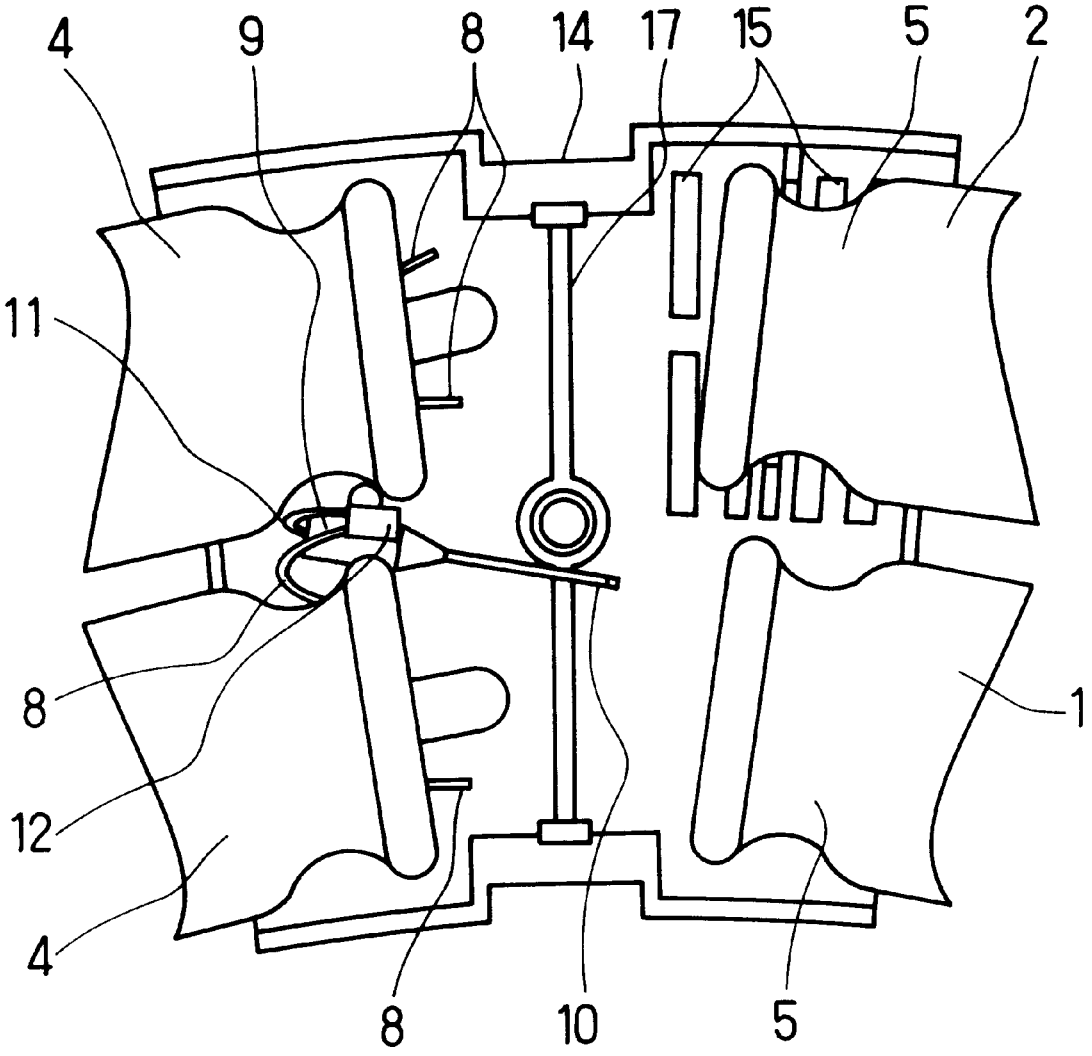

As shown in FIG. 5, one of lead wires 11 of the thermal fuse 9 and one of the outer lead wires 8 are connected to each other by using a solderless contact 12. Then, as shown in FIG. 6, the annulus fluorescent tubes 1, 2 are placed on the lower half of the mouthpiece 14, and the thermal fuse 9 is placed between the two annulus fluorescent tubes 1, 2 at the portion close to the electrode seal portion. The solderless contact 12 is also placed between the two annulus fluorescent tubes.

Next, a silicone resin 13 is filled between the two annulus fluorescent tubes 1, 2 so that the silicone resin 13 covers the thermal fuse 9 and the solderless contact 12 completely. The proper amount of the silicone resin filled between the two annulus fluorescent tubes 1, 2 is approximately three grams. Then, the lead wire 10 of the thermal fuse 9 is fixed to the heat shielding wall 17 with an adhesive.

The lead wire 10 of the thermal fuse 9 and three outer lead wires 8 are inserted into the hollow lead terminals 16 fixed to the upper half of the mouthpiece 14. Then, the upper half of the mouthpiece 14 is placed on the lower half of the mouthpiece 4, and the upper and lower halves are fixed to each other with a screw. Finally, the lead wires 8, 10 are welded to each tip of the lead terminals 16.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes that come within the meaning and range of equivalency of the claims are intended to be embraced therein.

We claim:

1. An annulus fluorescent lamp, comprising:

a plurality of annulus fluorescent tubes formed into shapes having different diameters and disposed substantially concentrically in substantially the same plane, each of the annulus fluorescent tubes having a first end with electrodes and outer lead wires and a second end without electrodes, the second ends of the annulus fluorescent tubes being communicated with each other via a bridge portion so that a single discharge path is formed inside the plurality of annulus fluorescent tubes;

a mouthpiece covering the first and second ends of the annulus fluorescent tubes and having lead terminals; and an overheat protection component disposed in the mouthpiece and close to the electrode seal portion, the overheat protection component being connected electrically between at least one of the outer lead wires of the electrodes and one of the lead terminals of the mouthpiece, the overheat protection component being in thermal communication with the surface of the annulus fluorescent tubes at a portion close to the electrode seal portion via a resin, so that the overheat protection component cuts off current supply to the annulus fluorescent tubes corresponding to the heat conducted from the electrode seal portion via the resin when the electrode seal portion is overheated in a last period of the lamp life.

2. The annulus fluorescent lamp according to claim 1, wherein the over heat protection component is a thermal fuse.

3. The annulus fluorescent lamp according to claim 1, wherein the overheat protection component is disposed between a pair of annulus fluorescent tubes at the portion close to the electrode seal portion, and fixed to the surfaces of the pair of annulus fluorescent tubes at the portion close to the electrode seal portion with a resin.

4. The annulus fluorescent lamp according to claim 1, wherein the inner face of the mouthpiece has a heat shielding wall that shields thermally the second ends from the first ends of the annulus fluorescent tubes.

5. The annulus fluorescent lamp according to claim 1, wherein through holes for ventilation are provided for the mouthpiece at the portion corresponding to the second end of the annulus fluorescent tube.

6. The annulus fluorescent lamp according to claim 5, wherein the inner face of the mouthpiece has a holder that holds the annulus fluorescent tube at a portion close to the second end.

* * * * *